US005325077A

United States Patent [19]

Ishikawa et al.

[11] Patent Number: 5,325,077

[45] Date of Patent: Jun. 28, 1994

[54] $TE_{101}$ TRIPLE MODE DIELECTRIC RESONATOR APPARATUS

[75] Inventors: Youhei Ishikawa; Hidekazu Wada; Hiroshi Nishida; Seiji Hidaka, all of Nagaokakyo, Japan

[73] Assignee: Murata Manufacturing Co., Ltd., Japan

[21] Appl. No.: 937,240

[22] Filed: Aug. 28, 1992

[30] Foreign Application Priority Data

Aug. 29, 1991 [JP] Japan ..... 3-218391

[51] Int. Cl.[5] ..... H01P 7/10

[52] U.S. Cl. ..... 333/219.1; 333/235

[58] Field of Search ..... 333/202, 219, 219.1, 333/235; 331/96, 117 D, 107 DP

[56] References Cited

U.S. PATENT DOCUMENTS 3,696,314 10/1972 Kell et al. ..... 333/205
4,623,857 11/1986 Nishikawa et al. ..... 333/219

FOREIGN PATENT DOCUMENTS 0149903 6/1991 Japan .
1058014 11/1983 U.S.S.R. .

OTHER PUBLICATIONS

Patent Abstracts of Japan vol. 14 No. 161 (E-909) Mar. 28, 1990 and JP-A-20-16-801 19 Jan. 1990.

Julien et al., "Electromagnetic Analysis of Spherical Dielectric Shielded Resonator", IEEE Transactions on Microwave Theory and Techniques, vol. 34, No. 6, Jun. 1986 pp. 723-729.

Bezborodou et al., "Microwave filters using cross--shaped dielectric resonators", Telecommunications and Radio Engineering vol. 39/40, No. 4 Apr. 1985, pp. 121-123.

*Primary Examiner*—Seungsook Ham

*Attorney, Agent, or Firm*—Ostrolenk, Faber, Gerb & Soffen

[57] ABSTRACT

A dielectric resonator apparatus is provided with a dielectric resonator which has a generally spherical dielectric placed within a shield case having a rectangular cavity, and uses each resonance of a x mode, a y mode and a z mode of $TE_{101}$, where an electric field is caused respectively around a x axis, a y axis and a z axis of a rectangular coordinate system predetermined in the dielectric, and an external coupling means for coupling the above described resonator to an external circuit, whereby the dielectric resonator apparatus, which has no-load Q larger than in the conventional embodiment, can be made smaller in size, and also, can realize three resonators with one apparatus.

13 Claims, 12 Drawing Sheets x mode y mode z mode xy-even mode yz-even mode zx-even mode xy-odd mode yz-odd mode zx-odd mode

$TE_{101}$ TRIPLE MODE DIELECTRIC RESONATOR APPARATUS

BACKGROUND OF THE INVENTION

FIELD OF THE INVENTION

The present invention generally relates to dielectric resonator apparatus that uses resonances of spherical $TE_{101}$ modes (hereinafter referred to as spherical $TE_{101}$ modes) within a shield case having a rectangular cavity therein.

DESCRIPTION OF THE RELATED ART

Conventionally a dielectric resonator for microwave filter use (hereinafter referred to as a first conventional embodiment), which is cylindrical in shape and uses a $TE_{011}$ mode, is disclosed in, for example, Japanese Utility Model Laid-Open Publication No. 51-35946. When a microwave filter is constructed with the use of a dielectric resonator of the first conventional embodiment, one dielectric resonator is required to be used with respect to one filter. When many filters are constructed, many dielectric resonators are required, thereby causing problems with the volume that is occupied by the many dielectric resonators and the greater weight.

In order to make the size smaller and the weight lighter, a dielectric resonator apparatus (hereinafter referred to as a second conventional embodiment) using the resonances of $TM_{110}$ modes or their modified modes is disclosed in Japanese Patent Laid-Open Publication No. 61-157101. Such a dielectric resonator apparatus is shown in FIG. 12.

As shown in FIG. 12, a composite dielectric 202, which is made of ceramic, having integrally formed three pillar-shaped dielectrics 202*a*, 202*b*, 202*c* that are orthogonal to one another, is placed within a shield case 201 having a rectangular cavity therein. Resonances of three TM modes, namely, a $TM_{110}$ mode, a $TM_{011}$ mode and a $TM_{101}$ mode, exist in a xyz rectangular coordinate system with an axial direction of one pillar-shaped dielectric being in conformity with a z axis. In order to prevent the electromagnetic fields of the three TM modes from interfering with one another, coupling adjusting members 204, 205 which are composed of a pair of screw metallic bodies lying within a plane having the pillar shaped dielectrics 202*a*, 202*b* both included in it, are projected into the shield case 201 towards the center of the composite dielectric 202 from the ridge line portions 206, 207 of the shield case 201. In order to couple the above described dielectric resonator to an external circuit, for example, two coupling loops (not shown) for coupling the pillar-shaped dielectric 202*a* only are provided with the pillar-shaped dielectric 202*a* being grasped therebetween.

In a dielectric resonator apparatus of the second conventional embodiment constructed as described hereinabove, three resonators, which are orthogonal electrically in one shield case 201, can be accommodated, and three independent microwave filters can be realized when the above described three modes are set so as not to interfere with one another. The three modes are coupled by the adjustment of the inserting degree of the above described coupling adjusting members 204, 205 so that, for example, a three stage microwave filter can be realized.

As the composite dielectric 202 is placed in contact against the shield case 201 in the above described second conventional embodiment, the energies within the dielectric resonator are not concentrated toward the center of the composite dielectric 202 so that the electromagnetic field is distributed even on the side immediately inside the shield case 201. Therefore, the surface current flows to the inner wall of the shield case 201, thus resulting in large conductor loss. No-loads Q ($Q_0$) of the respective pillar-shaped dielectrics 202*a*, 202*b*, 202*c* are comparatively small. Accordingly, there arises a problem in that it is difficult to make the passing band width narrower when the microwave band passing filter is constructed with the use of the above dielectric resonator apparatus.

SUMMARY OF THE INVENTION

Accordingly, the present invention has been developed with a view to substantially eliminate the above discussed drawbacks inherent in the prior art and has for one of its essential objects to provide an improved dielectric resonator apparatus.

Another important object of the present invention is to provide an improved dielectric resonator apparatus which has no-load Q larger than in the conventional embodiment, can be made smaller in size, and also can realize three resonators with one apparatus.

In accomplishing these and other objects, according to one preferred embodiment of the present invention, there is provided a dielectric resonator apparatus described in accordance with a first embodiment, comprising a dielectric resonator which has a spherical or approximately spherical dielectric placed within a shield case having a the rectangular cavity therein, and uses each resonance of a x mode, a y mode and a z mode of $TE_{101}$ where an electromagnetic field is caused respectively around a x axis, a y axis and a z axis of a rectangular coordinate system predetermined in the above described dielectric, and an external coupling means for coupling the above described resonator to an external circuit.

A dielectric resonator apparatus described in accordance with a second embodiment includes the above described dielectric resonator in the dielectric resonator apparatus described in the first embodiment, the dielectric resonator is integrated with three ring shaped dielectrics, which are orthogonal with one another within the above described shield case, and a ring axis of each ring shaped dielectric is respectively formed in conformity with the above described x axis, y axis and z axis so that each ring shaped dielectric may operate in the resonance condition of a x mode, a y mode and a z mode of the above described $TE_{101}$.

In a dielectric resonator apparatus described in accordance with the first embodiment or second embodiment, a dielectric resonator apparatus described in accordance with a third embodiment is characterized in that each resonance of the x mode, the y mode and the z mode of the above described $TE_{101}$ is in a non-coupling condition in use with one another.

In a dielectric resonator apparatus described in accordance with the third embodiment, a dielectric resonator apparatus described in accordance with a fourth embodiment is characterized in that the above described non-coupling condition is achieved with a coupling adjusting member that is projected into the above described shield case so as to be operated with respect to each pair of two resonances in the non-coupling condition with one another in use.

In a dielectric resonator apparatus described in accordance with the third embodiment or fourth embodiment, the dielectric resonator apparatus described in accordance with a fifth embodiment is characterized in that respective resonances of the x mode, the y mode and the z mode of the above described $TE_{101}$ have resonance frequencies different to one another.

In a dielectric resonator apparatus described in accordance with the fifth embodiment a dielectric resonator apparatus described in a sixth embodiment is characterized in that respective resonances of the x mode, the y mode and the z mode of the above described $TE_{101}$ have resonance frequencies that different to one another as a result of concave portions that are formed respectively in the above described three ring shaped dielectrics corresponding to the above described respective resonances.

In a dielectric resonator apparatus described in accordance with each one of the third, fourth, fifth and sixth embodiment, a dielectric resonator apparatus described in accordance with a seventh embodiment is characterized in that the above described external coupling means is provided with a pair of coupling loops for each of the above described ring shaped dielectrics, respectively, the coupling loop of each pair are separated by a given distance from each of the respective above described ring shaped dielectrics so that each of the respective above described ring shaped dielectrics are positioned in between. The pairs of coupling loops are provided in accordance with each resonance of the x mode, the y mode and the z mode, respectively of the above described $TE_{101}$ so as to be interlinked with a magnetic field of the resonance of the x mode, the y mode or the z mode of the above described $TE_{101}$ so as to be inductively coupled with each of the respective above described ring shaped dielectrics.

In a dielectric resonator apparatus described in accordance with the first embodiment or second embodiment, a dielectric resonator apparatus described in accordance with a eighth embodiment is characterized in that two resonances of each pair of at least two pairs among three pairs of combinations between the respective resonances of the x mode, the y mode and the z mode of the above described $TE_{101}$ are mutually in a coupling condition in use.

In a dielectric resonator apparatus described in accordance with the eighth embodiment, a dielectric resonator apparatus described in accordance with the ninth embodiment is characterized in that the above described coupling condition is achieved with a concave portion formed in a cross portion where the above described two ring shaped dielectrics corresponding to two resonances in the coupling condition in practical use are crossed.

In a dielectric resonator apparatus described in accordance with the eighth embodiment or ninth embodiment, a dielectric resonator apparatus described in accordance with a tenth embodiment is characterized in that two resonance of at least one pair of two resonances among three pairs of combinations between the respective resonances of the x mode, the y mode and the z mode of the above described $TE_{101}$ are in a non-coupling condition to each other in use.

In a dielectric resonator apparatus described in accordance with the tenth embodiment, a dielectric resonator apparatus described in accordance with a eleventh embodiment is characterized in that the above described non-coupling condition is achieved with a coupling adjusting member that is projected into the above described shield case so as to be operated with respect to each pair of two resonances in the non-coupling condition to each other in practical use.

In a dielectric resonator apparatus described in accordance with the each one of eighth, ninth, tenth, or eleventh embodiment, a dielectric resonator apparatus described in a twelfth embodiment is characterized in that respective resonances of the x mode, the y mode and the z mode of the above described $TE_{101}$ have resonance frequencies different to one another.

In a dielectric resonator apparatus described in accordance with the twelfth embodiment, a dielectric resonator apparatus described in accordance with a thirteenth embodiment is characterized in that respective resonances of the x mode, the y mode and the z mode of the above described $TE_{101}$ having resonance frequencies that are mutually different are achieved by concave portions formed respectively in the above described three ring shaped dielectrics.

In a dielectric resonator apparatus described in accordance with the each one of the tenth, eleventh, twelfth, or thirteenth embodiment, a dielectric resonator apparatus described in accordance with a fourteenth embodiment is characterized in that the above described external coupling means is provided with a first coupling loop which is separated by a given distance from the above described first ring shaped dielectric and is adapted so as to be interlined with the magnetic field of the resonance to be caused from the above described first ring shaped dielectric, and a second coupling loop which is separated by a given distance from the above described second ring shaped dielectric and is adapted to be interlinked with the magnetic field of the resonance so as to be caused from the above described second ring shaped dielectric, at least between the above described two, first and second, ring shaped dielectrics corresponding to two resonances in a non-coupling condition mutually in the above described use.

A dielectric resonator apparatus described in accordance the first embodiment constructed as described hereinabove includes a dielectric resonator which has a spherical or approximately spherical dielectric placed within the rectangular cavity of the shield case, and uses each resonance of a x mode, a y mode and a z mode of $TE_{101}$ where an electric field is caused respectively around a x axis, a y axis and a z axis of a rectangular coordinate system predetermined in the above described dielectric, and an external coupling means for coupling the above described resonator to an external circuit. Three resonators using each resonance of the x mode, the y mode and the z mode of the above described $TE_{101}$ is realized in one apparatus, and the shape is spherical or approximately spherical, so that the size can be made smaller, the weight can be made lighter as compared with the second conventional embodiment that is formed with three pillar-shaped dielectrics being integrated. In the dielectric resonator apparatus in accordance with the present invention, the above described dielectric is concentrated near the central portion within the above described shield case. As the electromagnetic energies in each mode of the $TE_{101}$ are also distributed near the central portion of the above described shield case, the no-load Q ($Q_0$) is high as compared with the above described second conventional embodiment where the electromagnetic energies are not concentrated in the central portion. Accordingly, three microwave band passing filters having a passing band narrower than in the conventional embodiment can be realized.

In a dielectric resonator apparatus described in accordance with the first embodiment, a dielectric resonator apparatus described in the second embodiment is formed so that preferably the above described dielectric resonator is integrated with three ring shaped dielectrics being orthogonal mutually within the above described shield case, and the axis of the ring of each ring shaped dielectric is respectively put into conformity with the above described x axis, y axis and z axis so that each of the ring shaped dielectrics is operated in a resonance condition of the x mode, y mode and z mode of the above described $TE_{101}$.

In a dielectric resonator apparatus described in the first embodiment or second embodiment, a dielectric resonator apparatus described in accordance with the third embodiment is preferably in a non-coupling condition to one another in practical use in each resonance of the x mode, the y mode and the z mode of the above described $TE_{101}$.

In a dielectric resonator apparatus described in accordance with the third embodiment, a dielectric resonator apparatus described in accordance with the fourth embodiment is provided so that the above described non-coupling condition is achieved with a coupling adjusting member that is projected into the above described shield case so as to be operated with respect to each pair of two resonances in the non-coupling condition to each other in use.

In a dielectric resonator apparatus described in accordance with the third embodiment or fourth embodiment, the dielectric resonator apparatus described preferably has resonance frequencies different to one another in each resonance of the x mode, the y mode and the z mode of the above described $TE_{101}$.

In a dielectric resonator apparatus described in accordance with the fifth embodiment, a dielectric resonator apparatus described in the sixth embodiment is so arranged that respective resonances of the x mode, the y mode and the z mode of the above described $TE_{101}$ have resonance frequencies mutually different so as to achieve with concave portions formed respectively in the above described three ring shaped dielectrics corresponding to the above described respective resonances.

In a dielectric resonator apparatus described in accordance with the each one of the third, fourth, fifth or sixth embodiment, a dielectric resonator apparatus described in accordance with the seventh embodiment is so arranged that preferably the above described external coupling means is provided with each pair of coupling loops, which is separated by a given distance from each of the above described ring shaped dielectrics so as to grasp each of the above described ring shaped dielectrics, and is provided in accordance with each resonance of the x mode, the y mode and the z mode of the above described $TE_{101}$ so as to be interlinked with a magnetic field of the resonance of the x mode, the y mode or the z mode of the above described $TE_{101}$ so as to be caused from each of the above described ring shaped dielectrics. Therefore, mutually independent three microwave filters can be realized.

In a dielectric resonator apparatus described in accordance with the first embodiment or second embodiment, a dielectric resonator apparatus described in accordance with the eighth embodiment is so arranged that preferably two resonances of each pair of at least two pairs among three pairs of combination between the respective resonances of the x mode, the y mode and the z mode of the above described $TE_{101}$ are mutually in a coupling condition in use.

In a dielectric resonator apparatus described in accordance with the eighth embodiment, a dielectric resonator apparatus described in accordance with the ninth embodiment is so arranged that the above described coupling condition is achieved with a concave portion formed in a cross portion where the above described two ring shaped dielectrics corresponding to two resonances in a coupling condition in practical use are crossed.

In a dielectric resonator apparatus described in accordance with the eighth embodiment or ninth embodiment, a dielectric resonator apparatus described in accordance with the tenth embodiment is so arranged in that preferably two resonances of at least one pair among three pairs of combination between the respective resonances of the x mode, the y mode and the z mode of the above described $TE_{101}$ are mutually in a non-coupling condition in practical use.

In a dielectric resonator apparatus described in accordance with the tenth embodiment, a dielectric resonator apparatus described in accordance with the eleventh embodiment is so arranged in that the above described non-coupling condition is achieved with a coupling adjusting member that is into the above described shield case so as to be operated with respect to each pair of two resonances in the non-coupling condition mutually in use.

In a dielectric resonator apparatus described in accordance with each one of the eighth, ninth, tenth or eleventh embodiment, a dielectric resonator apparatus described in the twelfth embodiment is characterized that preferably respective resonances of the x mode, the y mode and the z mode of the above describe $TE_{101}$ have resonance frequencies different to one another.

In a dielectric resonator apparatus described in accordance with the twelfth embodiment, a dielectric resonator apparatus described in accordance with the thirteenth embodiment is so arranged that respective resonances of the x mode, the y mode and the z mode of the above described $TE_{101}$ having resonance frequencies mutually different are achieved by concave portions formed respectively in the above described three ring shaped dielectrics corresponding to the above described respective resonances.

In a dielectric resonator apparatus described in accordance with each one of tenth, eleventh, twelfth, or thirteenth embodiment, a dielectric resonance apparatus described i accordance with the fourteenth embodiment is so arranged that preferably the above described external coupling means is provided with a first coupling loop which is separated by a given distance from the above described first ring shaped dielectric and is adapted so as to be interlined with the magnetic field of the resonance to be caused from the above described first ring shaped dielectric, and a second coupling loop which is separated by a given distance from the above described second ring shaped dielectric and is adapted so as to be interlinked with the magnetic field of the resonance to be caused from the above described second ring shaped dielectric, preferably between at least the above described two, first and second, ring shaped dielectrics corresponding to two resonances in a non-coupling condition mutually in the above described practical use. Therefore, three-stage of microwave band passing filters connected in a chain can be realized.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS OF THE INVENTION

Figure 1:
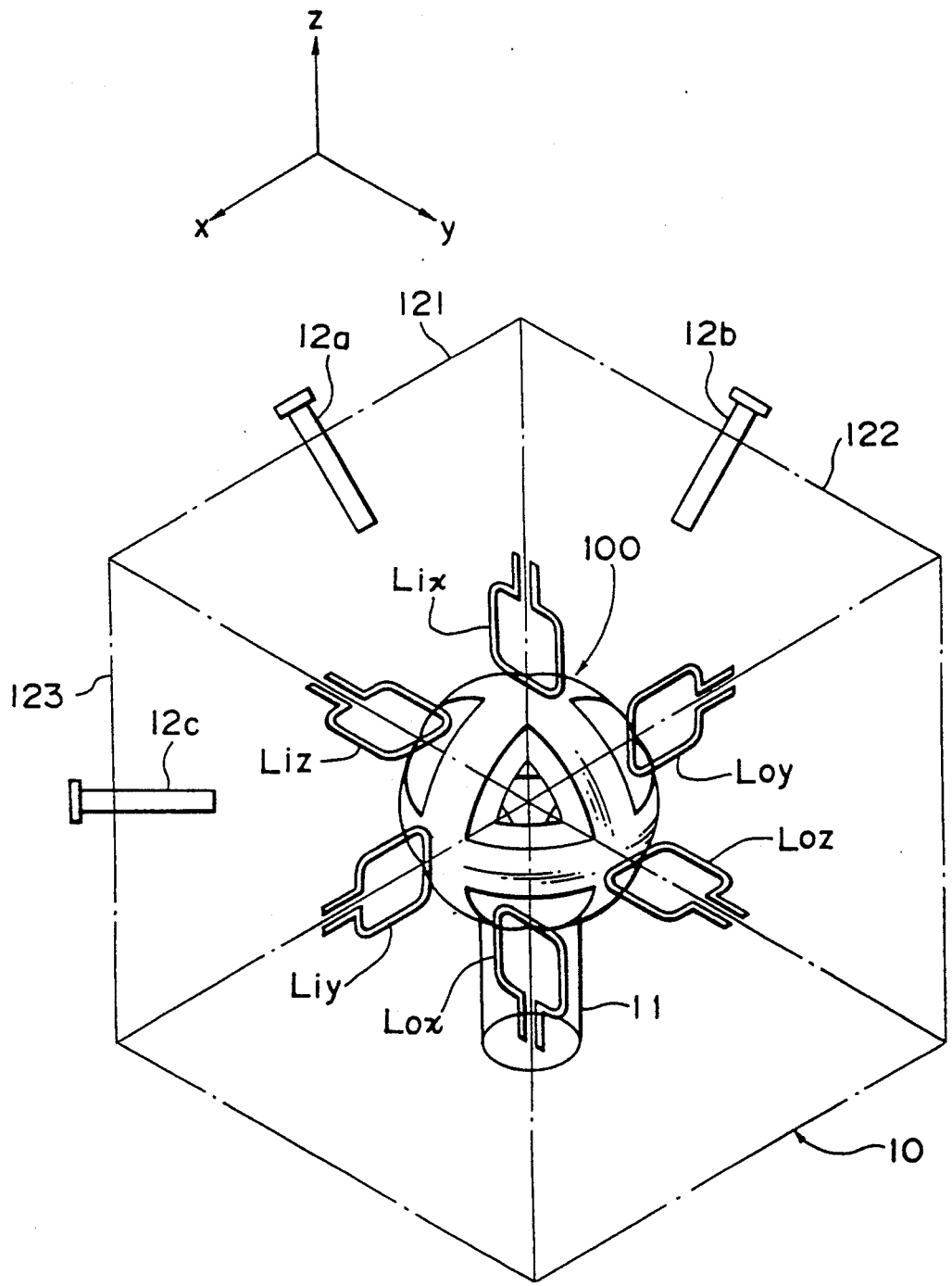
FIG. 1 is an oblique view of a dielectric resonator apparatus in a first embodiment in accordance with the present invention.
Figure 2:
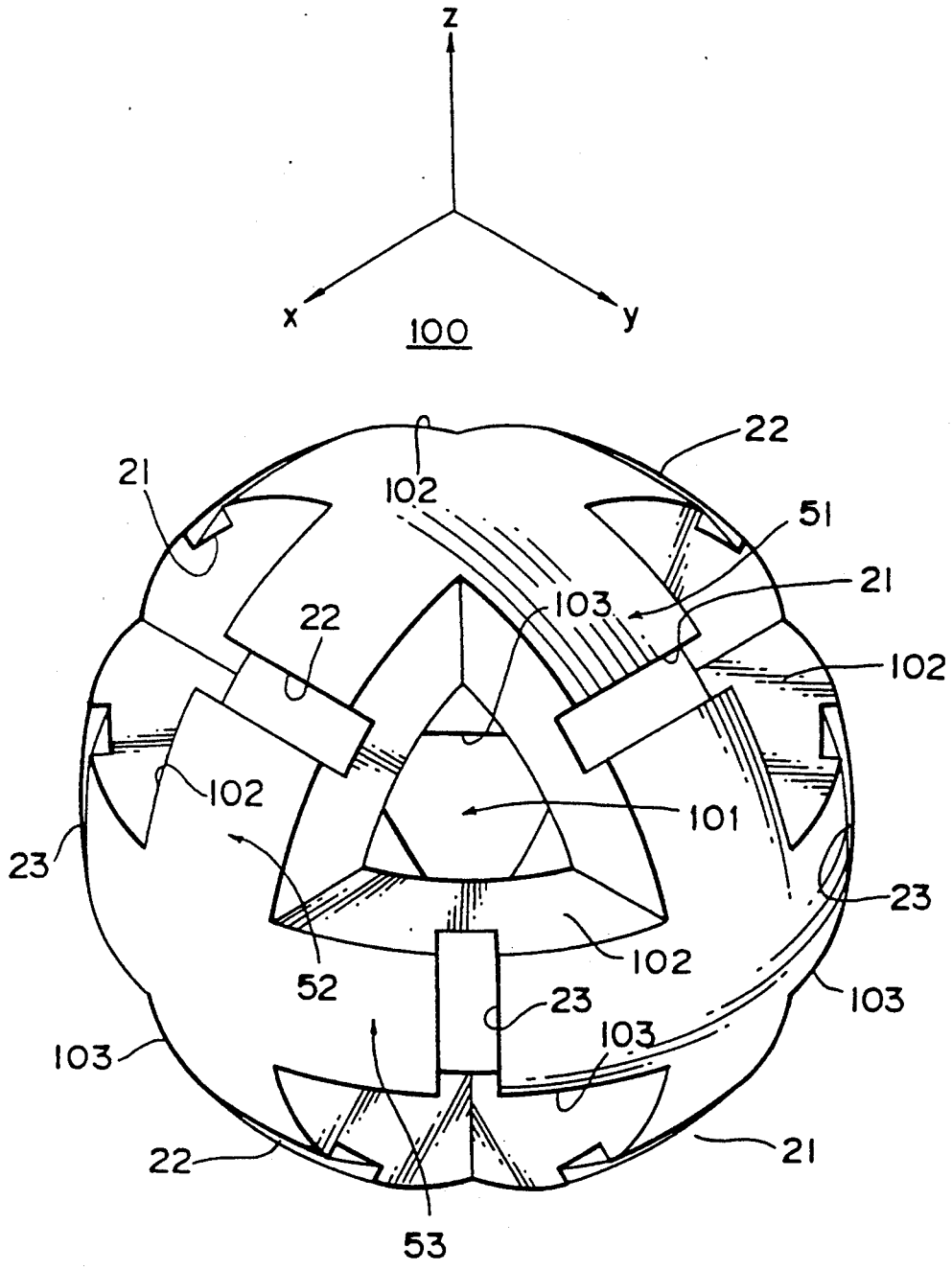
FIG. 2 is an oblique view of the dielectric resonator of FIG. 1.

Before the description of the preferred embodiment of the present invention proceeds, it is to be noted that like parts are designated by like reference numerals throughout the accompanying drawings. First Embodiment FIG. 1 shows a dielectric resonator apparatus in a first embodiment in accordance with the present invention. FIG. 2 shows a dielectric resonator for use in the dielectric resonator apparatus.

Figure 9A:
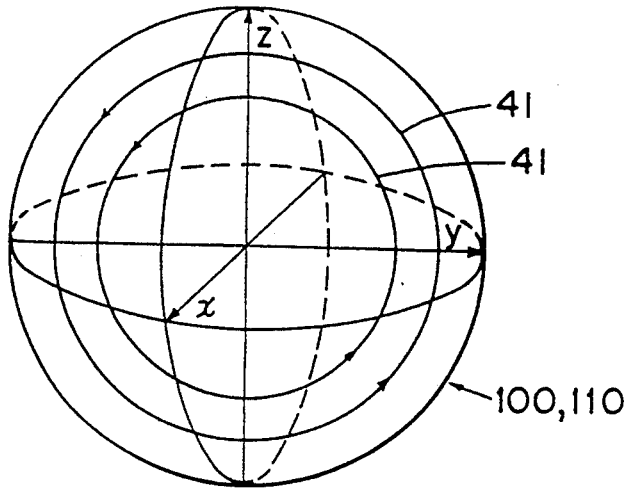
FIGS. 9*a*, 9*b* and 9*c* are oblique views showing respective electric force lines of a x mode, a y mode and a z mode in a dielectric resonator according to the first and second embodiments.
Figure 9B:
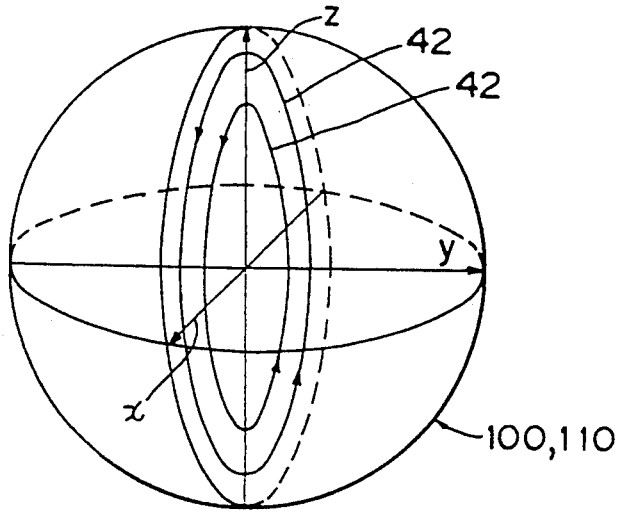
Figure 9C:
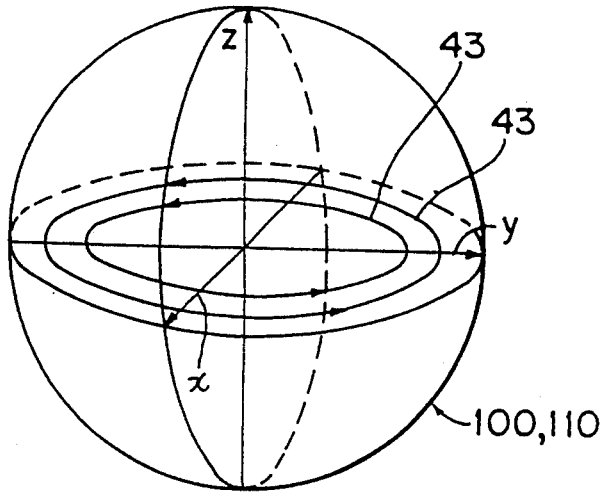

A dielectric resonator apparatus in a first embodiment has an approximately spherical dielectric resonator 100 placed within a shield case 10 having a rectangular cavity. The dielectric resonator 100 has three ring shaped dielectrics 51, 52, 53 being orthogonal to one another, and also, has loops Lix, Lox, Liy, Loy, Liz, Loz for input, output coupling use provided so as to be inductively coupled to the magnetic fields of mutually independent respective resonators REx, REy, REz (see FIG. 3) by the resonance of three modes when the polar axis of the $TE_{101}$ mode is put into conformity with mutually orthogonal the x axis, the y axis and the z axis with the use of the resonance of the $TE_{101}$ mode, which is a basic mode of the dielectric resonator 100. The three modes when the polar axis of the $TE_{101}$ mode is in conformity with a x axis, a y axis and a z axis, which are Orthogonal to one another, with the center of the dielectric resonator 100 being as a center, are as follows. The distribution of the electric force lines 41, 42, 43 in each mode are shown in FIGS. 9 (*a*), (*b*) and (*c*).

(a) $TE_{101}^{(x)}$ mode (hereinafter referred to as x mode)
(b) $TE_{101}^{(y)}$ mode (hereinafter referred to as y mode)
(c) $TE_{101}^{(z)}$ mode (hereinafter referred to as z mode)

As shown in FIG. 1, an approximately spherical-shaped dielectric resonator 100 is placed on a cylindrical shaped support stand 11, which is comparatively as low as, for example, approximately 4 through 6 in specific inductive capacity and has a linear expansion coefficient the same as that in the dielectric resonator 100, in the central portion within the metallic shield case 10 having the rectangular cavity. Each of the dielectrics 51, 52, 53 of the dielectric resonator 100 is composed of a ceramic dielectric with ZrSn being mixed with, for example, $TiO_2$ as a main component. In order to prevent a spurious mode, which is a high order mode except for the spherical $TE_{101}$ mode, from being caused, a spherical shaped cavity portion 101 is formed in the central portion of the spherical dielectric resonator 100 as shown in FIG. 2. Four, approximately triangle cone trapezoidal, notch portions 102 are formed in the upper side portion of the above described sphere and four, approximately triangle cone trapezoidal, notch portion 103 are formed in the lower side portion of the above described sphere so that only a portion of given thickness may remain from the above described spherical surface where the respective electric force lines (see FIG. 9) of the above described x mode, the y mode and the z mode are distributed, and may extend through to the cavity portion 101 from the above described spherical surface. Namely, the above described dielectric resonator 100 is approximately spherical so that the shafts of the respective rings of three ring shaped dielectrics 51, 52, 53 may be in conformity with the above described x axis, y axis and z axis and be integrated in mutually orthogonal condition.

Figure 3:
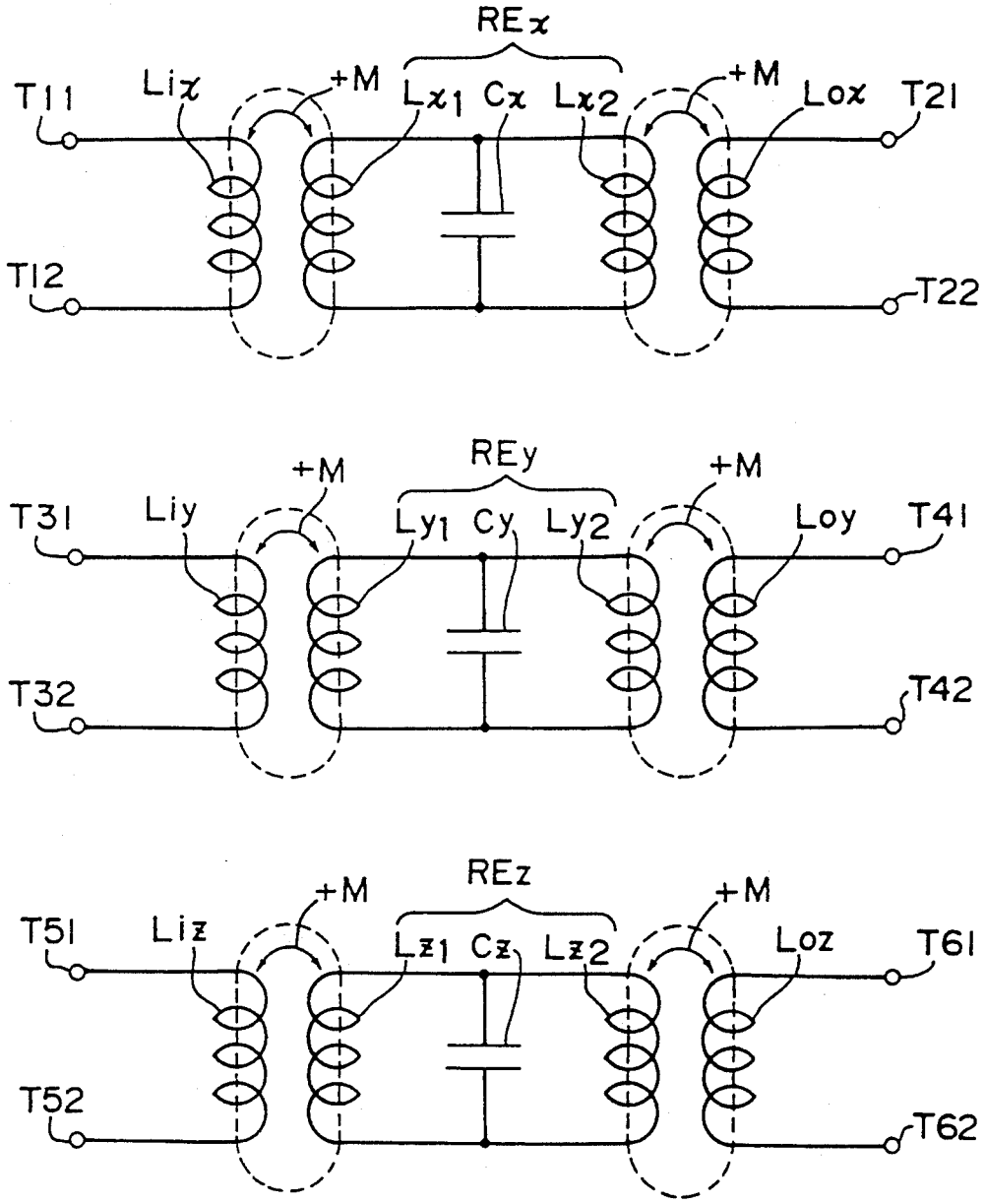
FIG. 3 is a circuit diagram of an equivalent circuit in the dielectric resonator apparatus of FIG. 1.

As the above described respective ring shaped dielectrics 51, 52, 53 respectively can distinguish among the respective electromagnetic field distribution of the x mode, the y mode and the z mode, the dielectric resonators REx, REy, REz of the above described x mode, the y mode and the z mode where the mutual mode couplings are not substantially provided, as shown in the equivalent circuit in FIG. 3, can be constructed. In a process where the spurious mode of a higher order mode except for the spherical $TE_{101}$ mode can be removed, and also, in a process to be formed by the burning of the dielectric resonator 100, uneven burning can be reduced, with an advantage that possibility of being cracked is reduced.

The shield case 10 may be a metallic electrode film for shield use formed on the inner face or the outer face of a rectangular cavity composed of ceramic of a material the same as, for example, the dielectric resonator 100.

In order to make different the respective resonance frequencies of the respective dielectric resonators REx, REy, REz, a concave r notch portion 21 for frequency adjusting use, which is provided with a given thickness from the outer peripheral surface and is approximately rectangular in shape, is formed respectively in the external peripheral surface of four positions, each being separated by ninety degrees with the shaft of the ring shaped dielectric 51 being provided as a center, and also, four concave or notch portions 22, 23 for frequency adjusting use respectively are formed in ring shaped dielectrics 52, 53. The respective concave portions 21, 22, 23 are made larger in thickness so that the resonance frequencies of the above described respective resonators REx, REy, REz can be made higher. In the present embodiment, the respective concave portions 21, 22, 23 are made different mutually in thickness so that the respective resonance frequencies of the respective dielectric resonators REx, REy, REz can be made different.

Generally the x mode, the y mode and the z mode are coupled with one another. The following six modes are defined as modes in these cases.

Figure 10A:
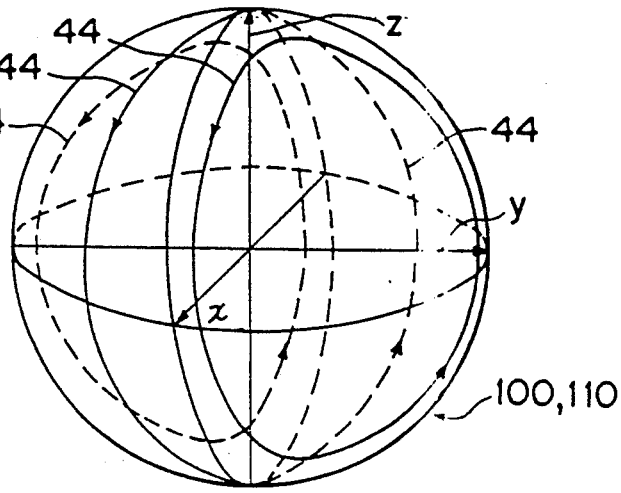
FIGS. 10*a*, 10*b* and 10*c* are oblique views showing respective electric force lines of a xy- even mode, a yz- even mode, and a zx- even mode in the dielectric resonator according to the first and second embodiments.
Figure 10B:
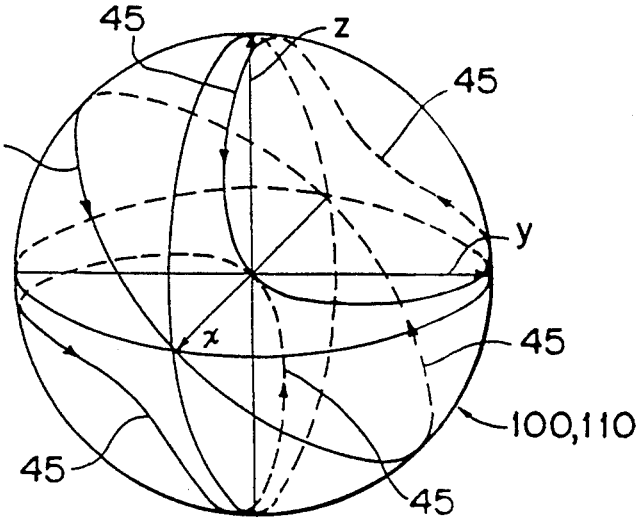
Figure 10C:
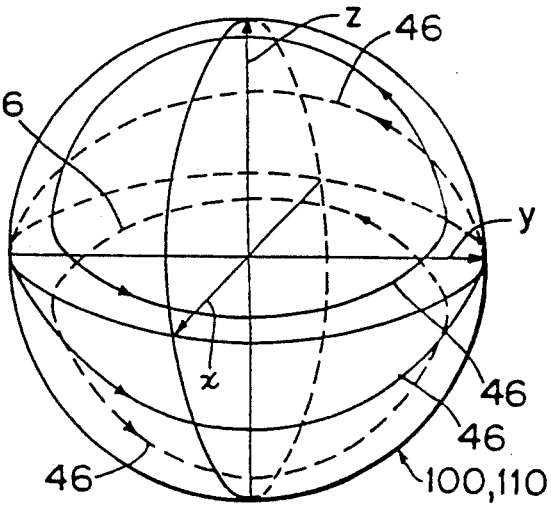

(a) A xy- even mode is a mode of an electromagnetic field in a case where each electromagnetic field of a x mode and a y mode is superposed with the same sign. The electromagnetic field of the mode is expressed with the next "Numerical Equation 1" and electric force lines 44 are distributed in the dielectric resonator 100 as shown in FIG. 10(*a*).

Numerical Equation 1

(electromagnetic field of $xy$ – even mode) = $C_0$\{(electromagnetic field of $x$ mode) + (electromagnetic field of $y$ mode)\} wherein $C_0$ is a normalized constant, in the present embodiment it is an inverse number of a square root of 2.

Figure 11A:
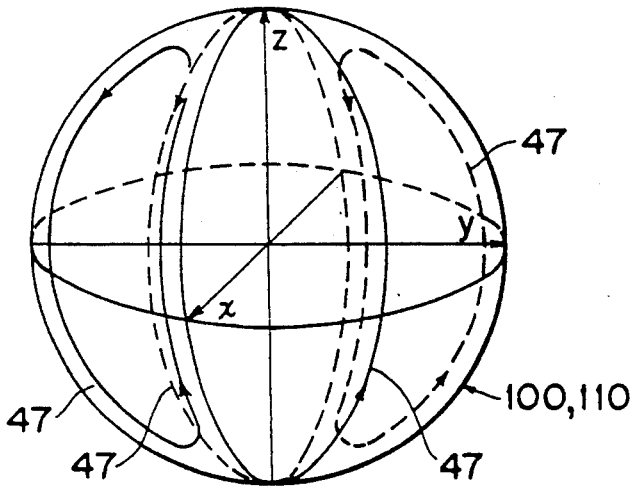
FIGS. 11*a*, 11*b* and 11*c* are oblique views showing respective electric force lines of a xy- odd mode, a yz- odd mode and a zx- odd mode in the dielectric resonator according to the first and second embodiments.
Figure 11B:
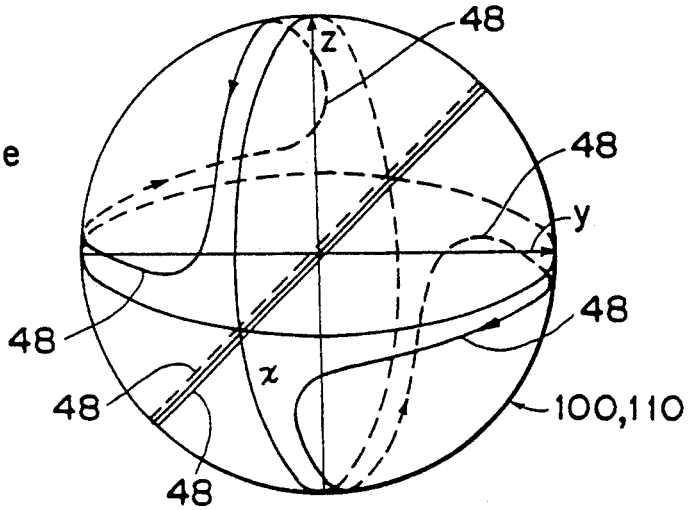
Figure 11C:
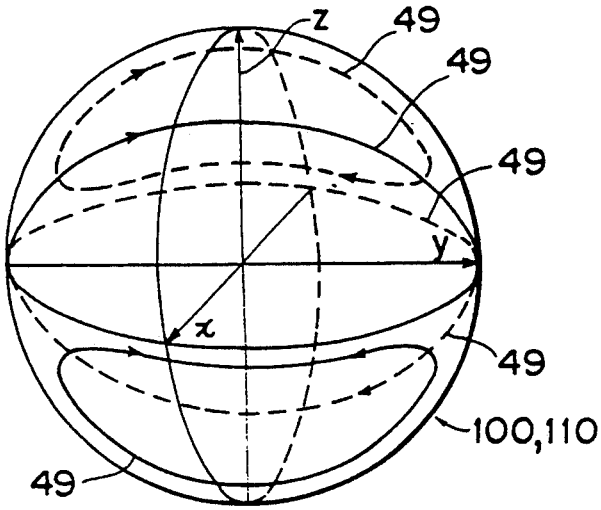
Figure 12:
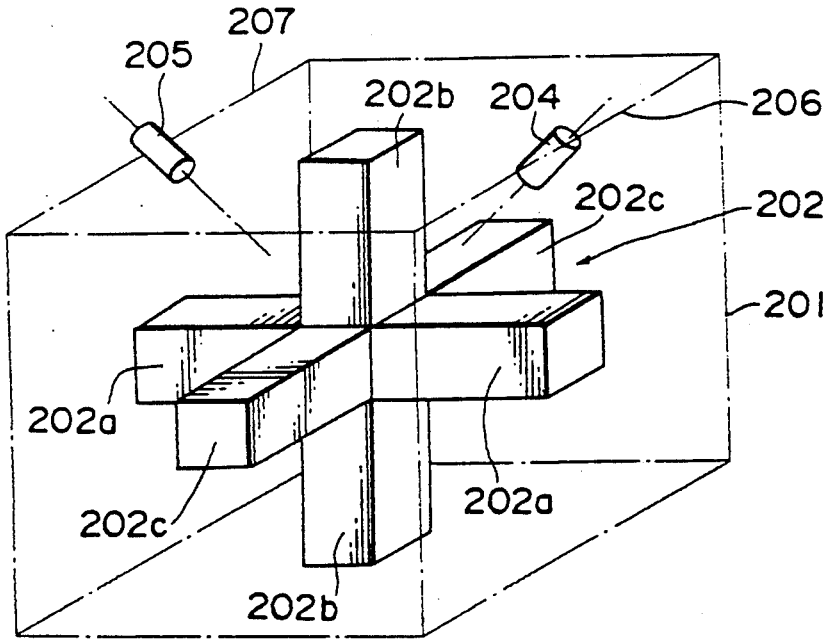
Fig. 12 PRIOR ART
FIG. 12 is an oblique view of a dielectric resonator apparatus in the second conventional embodiment described above.

(b) A xy- odd mode is a mode of an electromagnetic field in a case where each electromagnetic field of a x mode and a y mode is superposed with an inverse sign. The electromagnetic field of the above described mode is expressed with the next "Numerical Equation 2" and electric force lines 47 are distributed in the dielectric resonator 100 as shown in FIG. 11(*a*).

Numerical Equation 2

(electromagnetic field of $xy$ – odd mode) = $C_0$\{(electromagnetic field of $x$ mode) + (electromagnetic field of $y$ mode)\}

(C) A yz- even mode is a mode of an electromagnetic field in a case where each electromagnetic field of the y mode and the z mode are superposed with the same sign. The electromagnetic field of the mode is expressed with this next "Numerical Equation 3" and electric force lines 45 are distributed in the dielectric resonator 100 as shown in FIG. 10(*b*).

Numerical Equation 3

(electromagnetic field of $yz$ – even mode) = $C_0$\{(electromagnetic field of $y$ mode) + (electromagnetic field of $z$ mode)\}

(d) A yz- odd mode is a mode of an electromagnetic field in a case where each electromagnetic field of the y mode and the z mode is superposed with an inverse sign. The electromagnetic field of this mode is expressed with the next "Numerical Equation 4" and the electric force lines 48 are distributed in the dielectric resonator 100 as shown in FIG. 11(*b*).

Numerical Equation 4

(electromagnetic field of $yz$ – odd mode) = $C_0$\{(electromagnetic field of $y$ mode) + (electromagnetic field of $z$ mode)\}

(e) A zx- even mode is a mode of an electromagnetic field in a case where each electromagnetic field of a z mode and a x mode is supposed with the same sign. The electromagnetic field of this mode is expressed with the next "Numerical Equation 5". Electric force lines 46 are distributed in the dielectric resonator 100 as shown in FIG. 10(*c*).

Numerical Equation (electromagnetic field of $zx$ – even mode) = $C_0$\{(electromagnetic field of $z$ mode) + (electromagnetic field of $x$ mode)\}

(f) A zx- odd mode is a mode of an electromagnetic field in a case where each electromagnetic field of a z mode and a x mode is superposed with an inverse sign. The electromagnetic field of the mode is expressed with the next "Numerical Equation 6". Electric force lines 49 are distributed in the dielectric resonator 100 as shown in FIG. 11(*c*).

Numerical Equation 6

(electromagnetic field of $zx$ – odd mode) = $C_0$\{(electromagnetic field of $z$ mode) + (electromagnetic field of $x$ mode)\}

In order to prevent the respective electromagnetic fields of the x mode, the y mode and the z mode from being interfered with one another, a coupling adjusting member 12*a* composed of a screw shaped metallic conductor, a dielectric or a magnetic material is provided at one side of the upper surface of the shield case 10 parallel to the xy plane and so as to project into the shield case 10 towards the center of the dielectric resonator 100 from the central portion of the ridge line portion 121 parallel to the x axis. A coupling adjusting member 12*b* composed of a similar material is provided at another side of the upper surface of the shield case 10 parallel to the xy plane and so as to project into the shield case 10 towards the center of the dielectric resonator 100 from the central portion of the ridge line portion 122 parallel to the y axis. Further, a coupling adjusting member 12*c* composed of a similar material is provided at one side on a side face of the shield case 10 parallel to the xz plane and so as to project into the shield case 10 toward the center of the dielectric resonator 100 from the central portion of the ridge line portion 123 parallel to the z axis.

The coupling between the y mode and the z mode can be adjusted by the insertion of the coupling adjusting member 12*a* into the shield case 10 so as to mainly give influences to the resonance frequency of the dielectric resonator REx of the x mode. The coupling between the z mode and the x mode can be adjusted by the insertion of the coupling adjusting member 12*b* into the shield case 10 so as to mainly give influences to the resonator frequency of the dielectric resonator REy of the y mode. Further, the coupling between the x mode and the y mode can be adjusted by the insertion of the coupling adjusting member 12*c* into the shield case 10 so as to mainly give influences to the resonance frequency of the dielectric resonator REz of the z mode.

When the respective coupling adjusting members 12*a*, 12*b*, 12*c* are inserted into the shield case 10, the x mode, the y mode and the z mode which are mutually independent when they are not inserted are adapted so as to be coupled with respect to one another. The resonance frequencies of the respective dielectric resonators REx, REy, REz are changed as follows in accordance with the division between a case where materials of the coupling adjusting materials 12a, 12b, 12c are metallic conductors and a case where they are a dielectric or a magnetic material.

(A) When the coupling adjusting member is a metallic conductor, the variation $\delta\omega$ in the resonance angle frequency $\omega$ of the respective dielectric resonators REx, REy, REz is expressed with the next "Numerical Equation 7".

$$\frac{\delta\omega}{\omega} = \frac{\Delta Wm - \Delta We}{Wm + We}$$

where Wm is an magnetic energy to be included in the dielectric resonator, We is an electric energy to be included in the dielectric resonator. ΔWm is an magnetic energy to be included in a region to be occupied by a coupling adjusting member, and ΔWe is an electric energy to be included in a region to be occupied by a coupling adjusting member.

In the dielectric resonator apparatus, the resonance electromagnetic field of the spherical $TE_{101}$ mode has magnetic energy larger than electric energy, namely, $\Delta Wm - \Delta We > 0$ on the side immediately inside to the shield case 10. Therefore, when the coupling adjusting member which is a metallic conductor is inserted into the shield case 10, the resonance frequency of the dielectric resonator corresponding to the coupling adjusting member rises.

(B) When the coupling adjusting member is a dielectric or a magnetic material, the change $\delta\omega$ in the resonance angle frequency $\omega$ of the respective dielectric resonators REx, REy, REz is expressed with the next "Numerical Equation 8".

$$\frac{\delta\omega}{\omega} = \frac{\Delta Wm + \Delta We}{Wm + We}$$

When the coupling adjusting member which is a dielectric or a magnetic material is inserted into a shield case 10 as clear from the "Numerical Equation 8", the resonance frequency of the dielectric resonator corresponding to the coupling adjusting member is lowered.

The respective coupling adjusting members 12a, 12b, 12c are operated similarly in any position when placed in the central portion of the ridge line portion of a side parallel to the side of the ridge line portions 121, 122 or 123 where it is shown as placed. A coupling adjusting member may therefore be placed in the central portion of the ridge line portion of all the sides of the shield case 10.

In the dielectric resonator apparatus of the present embodiment, three pairs of loops Lix, Lox, Liy, Loy, Liz, Loz for input, output coupling use are provided as follows so as to be inductively coupled to the magnetic fields of the respective resonators REx, REy, REz of the above described x mode, y mode and z mode and so as to be separated by given distances from the dielectric resonator 100.

In the loops Lix, Lox for input, output coupling use of the x mode, a face these loops form conforms to a plane the ring of the ring shaped dielectric 51 forms, and is vertical to the shaft of the ring, namely, a face the electric force line of the x mode forms. The loop Lix, Lox for input, output coupling use of the x mode are provided so as to be inductively coupled to the magnetic field of the resonator REx of the x mode and so as to be opposed with the dielectric resonator 100 being positioned between. Both the ends of the loop Lix for input coupling use are connected with the input terminals T11, T12 (see FIG. 3) and also, both the ends of the loop Lox for output coupling use are connected with the output terminals T21, T22 (see FIG. 3). It is to be noted that the loop Lox for output coupling use is accommodated within the cylinder of the support stand 11.

In the loops Liy, Loy for input, output coupling use of the y mode, a face these loops form conforms to a plane the ring of the ring shaped dielectric 52 forms, and is vertical to the shaft of the ring, namely, a face the electric force line of the y mode forms. The loop Liy, Loy for input, output coupling use of the y mode are provided so as to be inductively coupled to the magnetic field of the resonator REx of the y mode and so as to be opposed with the dielectric resonator 100 being positioned between. Both the ends of the loop Liy for input coupling use are connected with the input terminals T31, T32 (see FIG. 3) and also, both the ends of the loop Loy for output coupling use are connected with the output terminals T41, T42 (see FIG. 3).

In the loops Liz, Loz for input, output coupling use of the z mode, a face these loops form conforms to a plane the ring of the ring shaped dielectric 53 forms, and is perpendicular to the shaft or axis of the ring, namely, a face the electric force line of the z mode forms. The loop Liz, Loz for input, output coupling use of the z mode are provided so as to be inductively coupled to the magnetic field of the resonator REz of the z mode and so as to be opposed with the dielectric resonator 100 being positioned between. Both the ends of the loop Liz for input coupling use are connected with the input terminals T51, T52 (see FIG. 3) and also, both the ends of the loop Loz for output coupling use are connected with the output terminals T61, T62 (see FIG. 3).

Here a plane of the loops LIx, Lox for input output, coupling use of the x mode form, a plane of the loops Liy, Loy for input, output coupling use of the y mode, and a plane of the loops Liz, Loz for input, output coupling use of the z mode form are orthogonal to one another. Accordingly, they are not inductively coupled to one another. The coupling among the resonators of the respective modes can be adjusted to zero by the adjustment of the respective insertion lengths of the coupling adjusting members 12a, 12b, 12c even when the respective resonators of the x mode, the y mode and the z mode are actually somewhat inductively coupled.

The equivalent circuit of the dielectric resonator apparatus in the present embodiment constructed as described hereinabove is shown in FIG. 3. As clear from FIG. 3, the respective circuits of the x mode, the y mode and the z mode are independent to one another and are in a trebly degenerated condition.

In a circuit of the x mode, a resonator REx of the x mode is composed of one capacitor Cx and two inductors $Lx_1$, $Lx_2$. The resonance frequency of the resonator REx is determined with these component elements. Here the inductor $Lx_1$ is inductively coupled (+M) to the input coupling loop Lix for input coupling use, while the inductor $Lx_2$ is inductively coupled (+M) to the output coupling loop Lox. In the circuit of the y mode, the resonator REy of the y mode is composed of one capacitor Cy and two inductors $Ly_1$, $Ly_2$. The resonance frequency of the resonator REy is determined by these component elements. Here the inductor $Ly_1$ is inductively coupled (+M) to the input coupling loop Liy for input coupling use, while the inductor $Ly_2$ is inductively coupled (+M) to the output coupling loop Lox. In the circuit of the z mode, the resonator REz of the z mode is composed of one capacitor Cz and two inductors $Lz_1$, $Lz_2$. The resonance frequency of the resonator REz is determined by these component elements. Here the inductor $Lz_1$ is inductively coupled (+M) to the input coupling loop Liz for input coupling use, while the inductor $Lz_2$ is inductively coupled (+M) to the output coupling loop Loz.

Electrostatic capacity of capacitors Cx, Cy, Cz to be included in the respective resonators REx, REy, REz respectively corresponds to the volume of concave or notch portions 21, 22, 23 for frequency adjusting use. When the volume of the concave or notch portions 21, 22, 23 is increased, the respective electrostatic capacity of the above described capacitors Cx, Cy, Cz becomes smaller and the resonator frequencies of the respective resonators REx, REy, REz rise. Inductances for each mode of the inductances $Lx_1$, $Lx_2$, $Ly_1$, $Ly_2$, $Lz_1$, $Lz_2$ to be included in the respective resonators REx, REy, REz respectively correspond to the insertion lengths of the coupling adjusting members **12*a*, 12*b*, 12*c*. If each insertion length of the coupling adjusting members 12*a*, 12*b*, 12*c* become long when, for example, the coupling adjusting members 12*a*, 12*b*, 12*c* are metallic conductors, inductance for each mode becomes smaller, and the resonance frequencies of the respective resonators REx, REy, REz rise The inductances $Ly_1$, $Ly_2$, $Lz_1$, $Lz_2$ are made somewhat smaller by the longer insertion length of the coupling adjusting member 12*a* as described hereinabove and influences are given even to the coupling between the y mode and the z mode. The inductances $Lz_1$, $Lz_2$, $Lx_1$, $Lx_2$ are made somewhat smaller by the long insertion length of the coupling adjusting member 12*b* and also influences are given even to the coupling between the z mode and the x mode. Further, the inductances $Lx_1$, $Lx_2$, $Ly_1$, $Ly_2$ are made somewhat smaller by the longer insertion length of the coupling adjusting member 12*c***, and influences are give even to the coupling between the x mode and the y mode.

In a dielectric resonator apparatus constructed as described hereinabove, the circuits of the resonators REx, REy, REz of three modes of the x mode, y mode and z mode are made independent to one another and also, the resonance frequencies of the respective resonators REx, REy, REz are made mutually different so that three independent microwave band passing filters which are mutually different in the central frequency in the passing band can be constructed with one dielectric resonator apparatus. As the dielectric resonator 100 is approximately spherical, it can be made considerably smaller in size and lighter in weight as compared with the second conventional embodiment formed with three integrated pillar-shaped dielectrics. As the dielectric of the dielectric resonator 100 is concentrated near the central portion within the above described shield case, the electromagnetic field energies in each mode of the $TE_{101}$ are distributed near the central portion of the above described shield case 10. Higher no-load Q ($Q_0$) is provided as compared with the second conventional embodiment where the electromagnetic field energies are not concentrated in the central portion. Therefore, there is an advantage in that three microwave band passing filters having narrower passing band than in the conventional embodiment can be realized.

In the above described first embodiment, although resonator frequencies of the resonators REx, REy, REz of each mode are made mutually different, the present invention is not restricted to it. The resonator frequencies of the two or all the resonators may be made the same.

Figure 4:
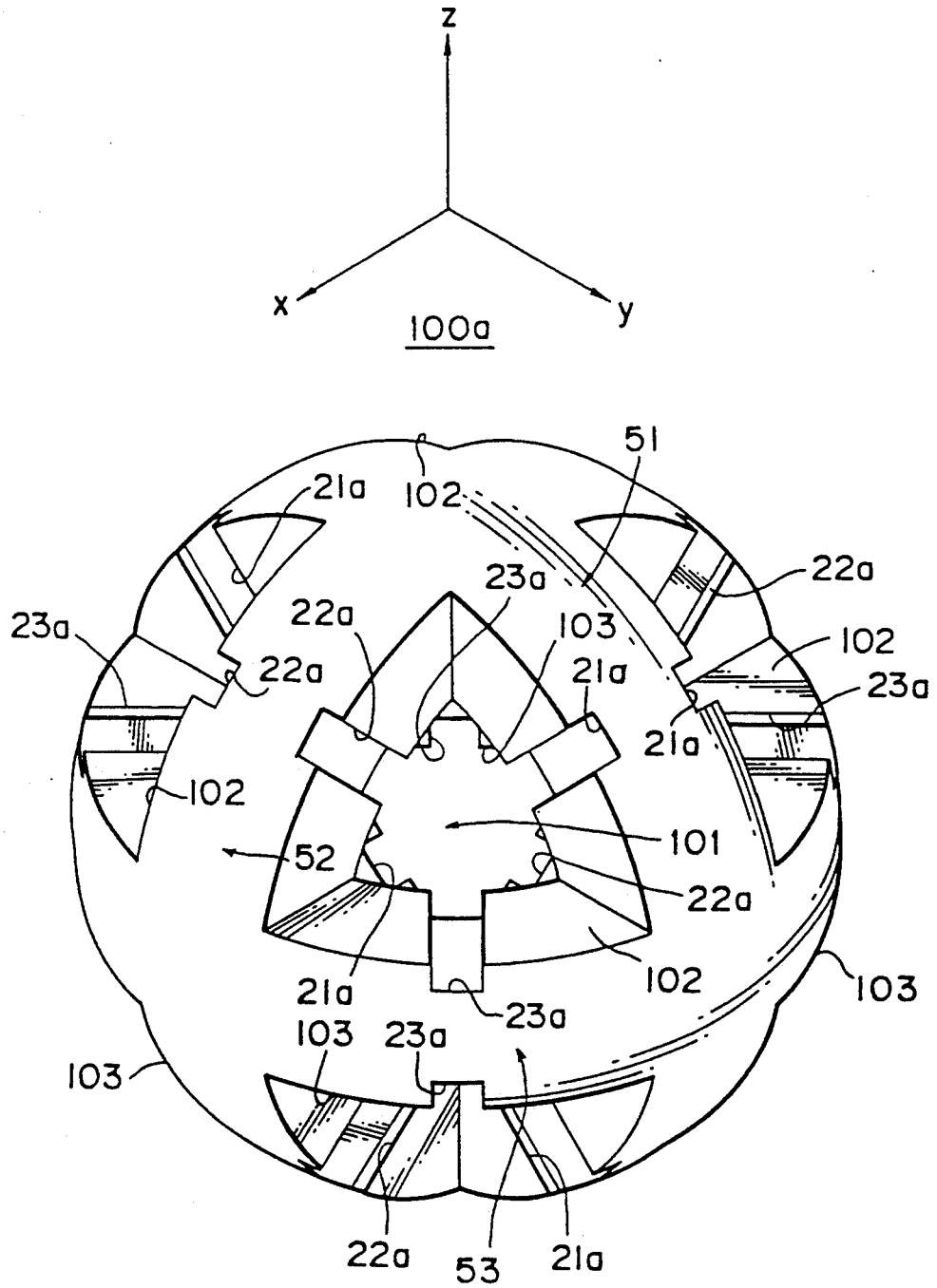
FIG. 4 is an oblique view of a modified embodiment of the dielectric resonator of FIG. 2.

A modified embodiment **100*a* of the dielectric resonator 100 of FIG. 2 is shown in FIG. 4. It is to be noted that like parts in FIG. 2 are designated by like reference numerals throughout the accompanying drawing in FIG. 4**.

Figure 5:
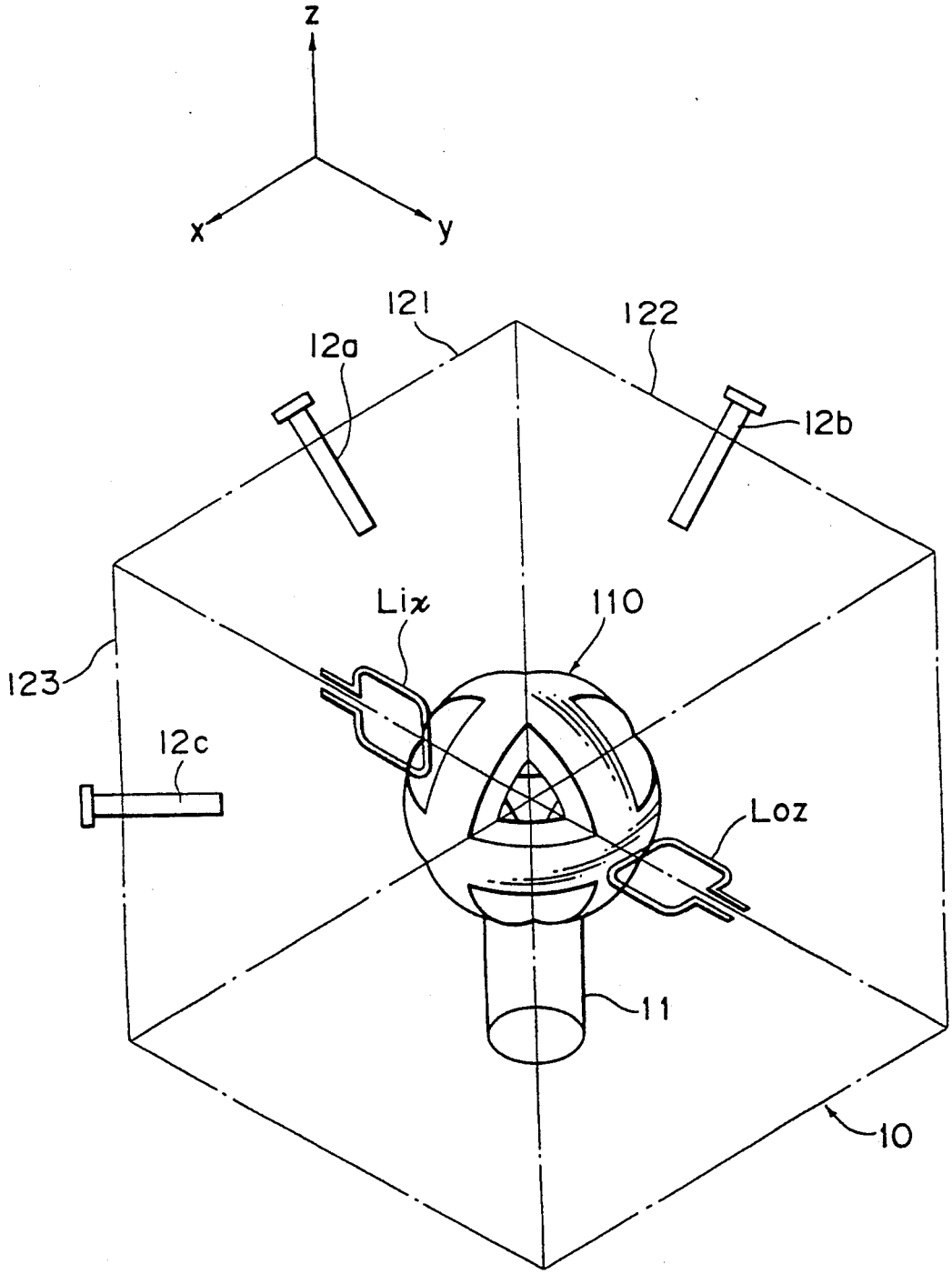
FIG. 5 is an oblique view of a dielectric resonator apparatus in a second embodiment in accordance with the present invention.
Figure 6:
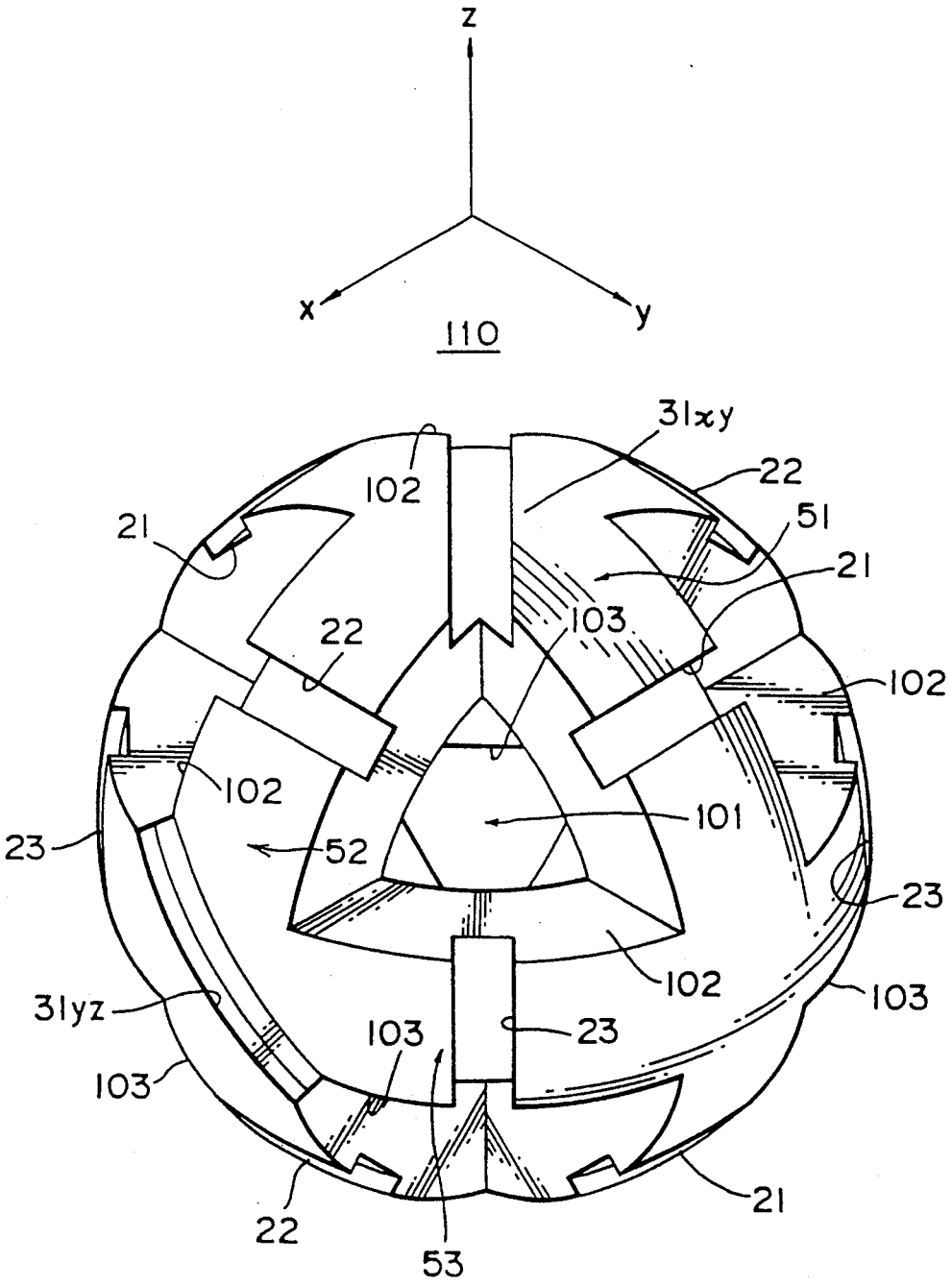
FIG. 6 is an oblique view of the dielectric resonator of FIG. 5.

The dielectric resonator **100*a* in the present embodiment is characterized to have a "]"-shaped section and a given length in a tangential direction of the ring so that the respective frequency adjusting concave or notch portions 21*a*, 22*a*, 23*a* have the respective surface central portions of the respective ring shaped dielectrics 51, 52, 53 intact as compared with the dielectric resonator 100 of FIG. 2. The respective frequency adjusting concave portions 21*a*, 22*a*, 23*a* may be optionally shaped so that one portion of the ring may remain so as to pass the electric force lines of each mode into the rings. Second Embodiment A dielectric resonator apparatus in a second embodiment in accordance with the present invention is shown in FIG. 5. A dielectric resonator 110 for use by the dielectric resonator apparatus is shown in FIG. 6. Referring to FIG. 5 and FIG. 6, it is to be noted that like parts in FIG. 1 and FIG. 2 are designated by like reference numerals throughout the accompanying drawings in FIG. 5 and FIG. 6**.

The dielectric resonator apparatus in the second embodiment is characterized to have a mode coupling between the x mode and the y mode, and between the y mode and the z mode as compared with the first embodiment of FIG. 1, and has a Lix and a Loz only provided as an input, output coupling loop. The differences between the first embodiment and the second embodiment will be described in detail hereinafter.

As shown in FIG. 6, a mode coupling concave or notch portion 31xy having a longitudinal length parallel to an angle direction of 45 degrees with respect to the plane of each ring, and a given depth is formed at the top portion of the dielectric resonator 110 which is a common portion between the ring shaped dielectric 51 of the x mode and the ring shaped dielectric 52 of the y mode as shown in FIG. 6. The resonator REx of the x mode is coupled electromagnetically to the resonator REy of the y mode so as to cause the mode coupling as a mode coupling concave or notch portion 31xy is formed at the cross portion of the electric force line of the x mode and the electric force line of the y mode. A mode coupling concave or notch portion 31yz having a length in the longitudinal direction parallel to an angle direction of 45 degrees with respect to the plane of each ring, and a given depth is formed on the side face portion of the dielectric resonator 110 which is the common portion between the ring shaped dielectric 52 of the y mode and the ring shaped dielectric 53 of the z mode. The resonator REy of the y mode and the resonator REz of the z mode are electromagnetically coupled so as to cause the mode coupling as the mode coupling concave or notch portion 31yz is formed in the cross portion between the electric force line of the y mode and the electric force line of the z mode.

In the present embodiment, the insertion length of the coupling adjusting member 12b is adjusted so that the resonator REx of the x mode is not coupled mutually to the resonator REz of the z mode.

Figure 7:
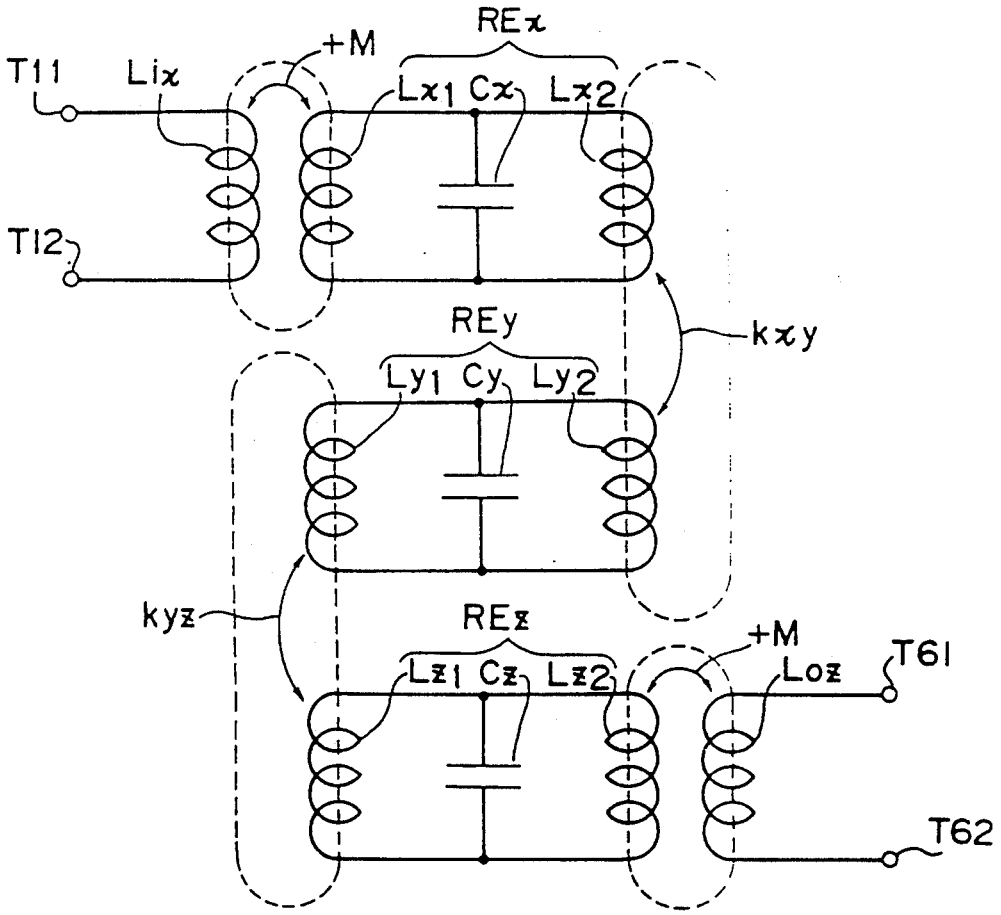
FIG. 7 is a circuit diagram of an equivalent circuit of the dielectric resonator apparatus of FIG. 5.

The equivalent circuit of the dielectric resonator apparatus in the present embodiment constructed as described hereinabove is shown in FIG. 7. As is clear from FIG. 7, a mode coupling is caused between the respective resonators REx, REy of the x mode and the y mode, and a mode coupling is caused between the respective resonators REy and REz of the y mode and the z mode. The inductance $Lx_2$ of the resonator REx of the x mode and the inductance $Ly_2$ of the y mode are inductively coupled with the inductive coupling coefficient kxy and the inductance $Ly_1$ of the resonator REy of the y mode and the inductance $Lz_1$ of the z mode are inductively coupled with the inductive coupling coefficient kyz. The inductive coupling coefficient Kzx between the z mode and the x mode is set to zero.

In the dielectric resonator apparatus constructed as described hereinabove, a three-stage of microwave band passing filter, with the circuits of the resonators REx, REy, REz of three modes, a x mode, a y mode and a z mode, being connected in a chain, can be composed of one dielectric resonator apparatus. The resonance frequencies of the resonators REx, REy, REz of each mode can be optionally set as in the first embodiment.

Figure 8:
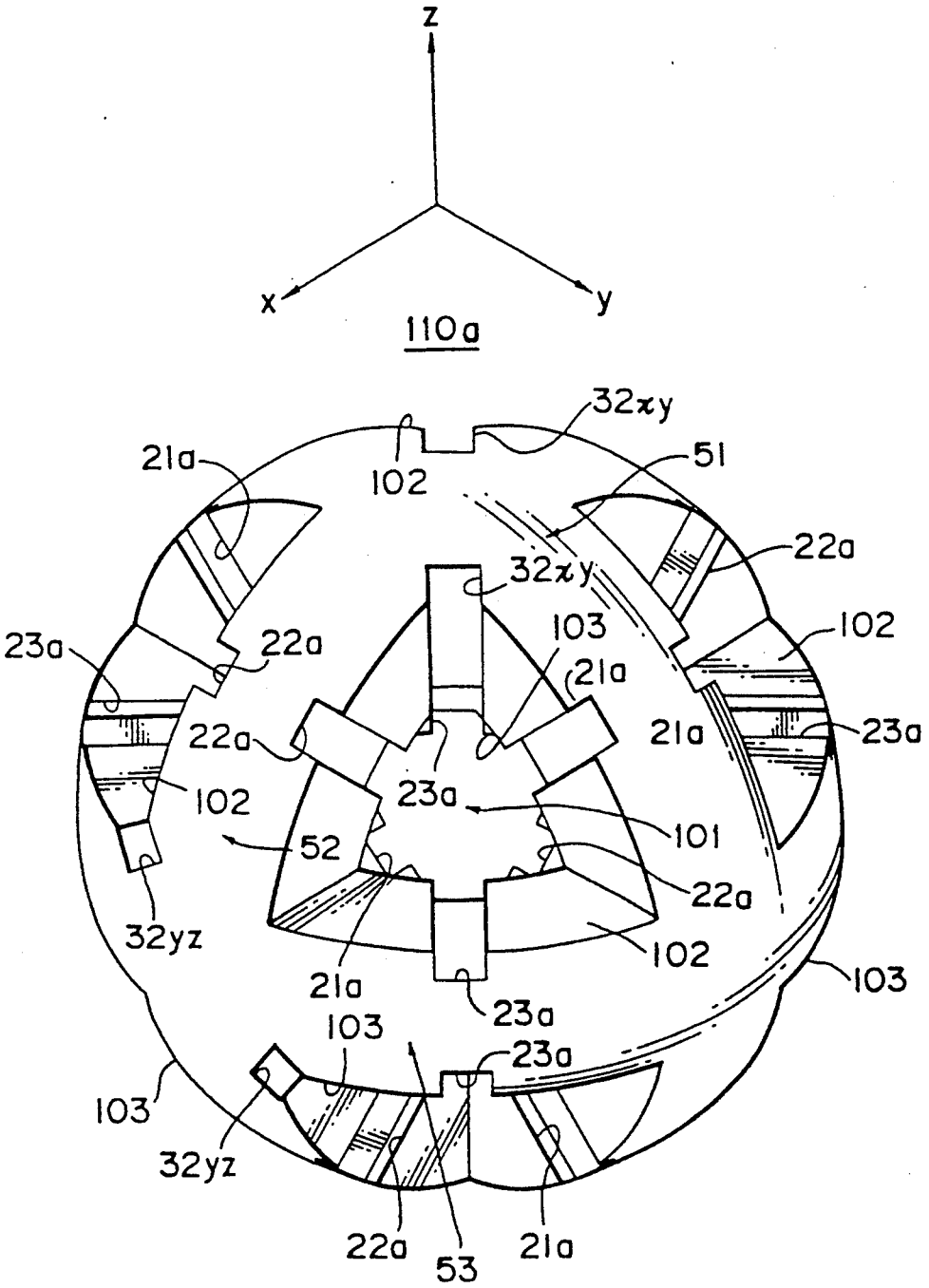
FIG. 8 is an oblique view of a modified embodiment of the dielectric resonator of FIG. 6.

A modified embodiment 110a of the dielectric resonator 110 of FIG. 6 is shown in FIG. 8. Referring to FIG. 8, it is to be noted that like parts in FIG. 6 are designated by like reference numerals throughout the accompanying drawings in FIG. 8.

In the dielectric resonator 110a in the modified embodiment, as compared with the dielectric resonator 110 of FIG. 6, each frequency adjusting concave or notch portions 21a, 22a, 23a has a "]"-character shaped section and a given length in the tangential direction of the ring so that the respective surface central portions of the respective ring shaped dielectrics 51, 52, 53 may be left intact. Also, the mode coupling concave or notch portions 32xy, 32yz have "]"-character shaped section so that the respective surface central portions of the respective ring shaped dielectrics 51, 52, 53 may be left intact. The respective frequency adjusting concaves or notches 21a, 22a, 23a and the mode coupling concave or notch portions 32xy, 32yz may be optionally shaped so that one portion of the ring may remain so as to pass the electric force lines of the respective modes into the rings.

In the above described second embodiment, a dielectric resonator apparatus is shown where a x mode is coupled in mode to a y mode, and a y mode is coupled in mode to a z mode. The present invention may be composed of, in addition to the above description, for example, a dielectric resonator apparatus where a x mode is coupled to a y mode, a z mode is independent, a dielectric resonator apparatus where a z mode is coupled to a x mode in addition to the mode coupling in the second embodiment. Other embodiments In the above described respective embodiments, a cavity portion 101 and notches 102, 103 are formed in the dielectric resonators 100, 100a, 110, 110a. The present invention may remain spherical in shape without formation of the cavity portion 101 and the notch portions 102, 103 in addition to it.

According to a dielectric resonator apparatus in accordance with the present invention as described hereinabove, a dielectric resonator which has a spherical or approximately spherical dielectric placed within the shield case having a rectangular cavity, and uses the respective resonances of the x mode, the y mode and the z mode of the $TE_{101}$ where the electric fields are caused respectively around the x axis, the y axis and the z axis Of the rectangular coordinate system predetermined in the above described dielectric, and an external coupling means for coupling the above described dielectric resonator to the external circuit are provided. Three pillar-shaped resonators using the respective resonances of the x mode, the y mode and the z mode of the above described $TE_{101}$ are realized by one apparatus and the shape is spherical or approximately spherical. Therefore, the size can be made considerably smaller, the weight considerably lighter as compared with the second conventional embodiment formed through the integration of the three pillarshaped dielectric. The electromagnetic energies are also distributed near the central portion of the above described shield case in each mode of the $TE_{101}$ as the above described dielectric is concentrated near the central portion within the above described shield case in the dielectric resonator apparatus in accordance with the present invention. No-load Q ($Q_0$) is higher as compared with the above described conventional embodiment where the electromagnetic field energies are not concentrated in the central portion. Therefore, there is an advantage in that three microwave band passing filters having a passing band narrower than in the conventional embodiment can be realized.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A dielectric resonator apparatus comprising a dielectric resonator having a generally spherical dielectric placed within a shield case having a rectangular cavity therein, and having three $TE_{101}$ mode resonances corresponding to a x mode, a y mode and a z mode, in which an electric field is provided respectively around a x axis, a y axis and a z axis of a rectangular coordinate system predetermined in the dielectric; and external coupling means for coupling the resonator to an external circuit, the dielectric being formed with three integrated ring shaped dielectric members that are mutually orthogonal within the shield case, and a central axis of each ring shaped dielectric member being in conformity with the x axis, y axis and z axis, respectively, so that each ring shaped dielectric member produces the $TE_{101}$ resonance of the x mode, the y mode and the z mode, respectively;

the respective $TE_{101}$ resonances of the x mode, the yo mode and the z mode having mutually different resonance frequencies and being in a non-coupled condition with each other, the non-coupled condition being produced with a plurality of coupling adjusting means, each projecting into the shield case so as to be operative with respect to respective pair of two $TE_{101}$ resonances that are in the mutually non-coupled condition, wherein the mutually different resonance frequencies of the respective $TE_{101}$ resonances are produced by notch portions formed in the three ring shaped dielectric members corresponding to the $TE_{101}$ resonances.

2. The dielectric resonator apparatus as defined in claim 1, where the external coupling means includes pairs of coupling loops, one pair of said pairs of coupling loops corresponding with each of the $TE_{101}$ resonances of the x mode, the y mode and the z mode, respectively, and being separated by a given distance from a respective one of the ring shaped dielectric members so that the respective ring shaped dielectric member is positioned in between the respective coupling loops of the corresponding one of said pairs of coupling loops, and interlinked with a corresponding magnetic field of one of the $TE_{101}$ resonances of the x mode, the y mode and the z mode that are respectively produced by each of the ring shaped dielectric members.

3. A dielectric resonator apparatus comprising a dielectric resonator having a generally spherical dielectric placed within a shield case having a rectangular cavity therein, and having three $TE_{101}$ mode resonances corresponding to a x mode, a y mode and a z mode, in which an electric field is provided respectively around a x axis, a y axis and a z axis of a rectangular coordinate system predetermined in the dielectric; and external coupling means for coupling the resonator to an external circuit, the dielectric being formed with three integrated ring shaped dielectric members that are mutually orthogonal within the shield case, and a central axis of each ring shaped dielectric member being in conformity with the x axis, y axis and z axis, respectively, so that ring shaped dielectric member produces the $TE_{101}$ resonance of the x mode, the y mode and the z mode, respectively, wherein the respective $TE_{101}$ resonances of the x mode, the y mode and the z mode form three pairs of resonances, the respective two $TE_{101}$ resonances of at least two of said pairs being in a coupled condition with each other, the coupled condition being produced with a first notch portion formed in a common portion where the two ring shaped dielectric members corresponding to the two $TE_{101}$ resonances in the coupled condition are crossed.

4. The dielectric resonator apparatus as defined in claim 3, where the respective two $TE_{101}$ resonances of at least one of said pairs are in a non-coupled condition with one another.

5. The dielectric resonator apparatus as defined in claim 4, where the non-coupled condition is produced with a coupling adjusting means that is projected into the shield case so as to be operative with respect to said pair of resonances in the non-coupled condition.

6. The dielectric resonator apparatus as defined in claim 3, where the respective $TE_{101}$ resonances of the x mode, the y mode and the z mode each have mutually different resonance frequencies.

7. The dielectric resonator apparatus as defined in claim 6, where the mutually different resonance frequencies are produced by second notch portions formed respectively in the three ring shaped dielectric members.

8. The dielectric resonator apparatus as defined in claim 4, where the external coupling means includes a first coupling loop which is separated by a given distance from a first ring shaped dielectric member and is positioned so as to be interlinked with a magnetic field of the resonance produced by the first ring shaped dielectric member, and a second coupling loop which is separated by a given distance from a second ring shaped dielectric member and is positioned so as to be interlinked with a magnetic field of the resonance produced by the second ring shaped dielectric member, wherein the first and second ring shaped dielectric members correspond to the two $TE_{101}$ resonances that are in the non-coupled condition.

9. The dielectric resonator apparatus as defined in claim 4, where the respective $TE_{101}$ resonances of the x mode, the y mode and the z mode each have mutually different resonance frequencies.

10. The dielectric resonator apparatus as defined in claim 5, where the respective $TE_{101}$ resonances of the x mode, the y mode and the z mode each have mutually different resonance frequencies.

11. The dielectric resonator apparatus as defined in claim 5, where the external coupling means includes a first coupling loop which is separated by a given distance from a first ring shaped dielectric member and is positioned so as to be interlinked with a magnetic field of the resonance produced by the first ring shaped dielectric member, and a second coupling loop which is separated by a given distance from a second ring shaped dielectric member and is positioned so as to be interlinked with a magnetic field of the resonance produced by the second ring shaped dielectric member, wherein the first and second ring shaped dielectric members correspond to the two $TE_{101}$ resonances that are in the non-coupled condition.

12. The dielectric resonator apparatus defined in claim 6, where the respective two $TE_{101}$ resonances of at least one of said pairs are in a non-coupled condition with one another; and the external coupling means includes a first coupling loop which is separated by a given distance from a first ring shaped dielectric member and is positioned so as to be interlinked with a magnetic field of the resonance produced by the first ring shaped dielectric member, and a second coupling loop which separated by a given distance from a second ring shaped dielectric member and is positioned so as to be interlinked with a magnetic field of the resonance produced by the second ring shaped dielectric member, wherein the first and second ring shaped dielectric members correspond to the two $TE_{101}$ resonances that are in the non-coupled condition.

13. The dielectric resonator apparatus defined in claim 7, where the respective two $TE_{101}$ resonances of at least one of said pairs are in a non-coupled condition with one another; and the external coupling means includes a first coupling loop which is separated by a given distance from a first ring shaped dielectric member and is positioned so as to be interlinked with a magnetic field of the resonance produced by the first ring shaped dielectric member, and a second coupling loop which is separated by a given distance from a second ring shaped dielectric member and is positioned so as to be interlinked with a magnetic field of the resonance produced by the second ring shaped dielectric member, wherein the first and second ring shaped dielectric members correspond to the two $TE_{101}$ resonances that are in the non-coupled condition.

* * * * *